US007229391B2

(12) United States Patent
Francis

(10) Patent No.: US 7,229,391 B2
(45) Date of Patent: Jun. 12, 2007

(54) RESISTANCE EXERCISE MACHINE WITH STACKED RESISTANCE PACKS

(75) Inventor: Paul S. Francis, Kansas City, MO (US)

(73) Assignee: Spira Flex, Inc., Kansas City, MO (US)

( * ) Notice: Subject to any disclaimer, the term of this patent is extended or adjusted under 35 U.S.C. 154(b) by 232 days.

(21) Appl. No.: 10/943,280

(22) Filed: Sep. 17, 2004

(65) Prior Publication Data

US 2006/0063650 A1 Mar. 23, 2006

(51) Int. Cl.
*A63B 21/045* (2006.01)
*A63B 21/00* (2006.01)
*A63B 21/06* (2006.01)

(52) U.S. Cl. ..... 482/127; 482/92; 482/94; 482/98

(58) Field of Classification Search ..... 482/92, 482/94, 99, 127, 114, 115, 133, 102, 103
See application file for complete search history.

(56) References Cited

U.S. PATENT DOCUMENTS

D194,042 S * 11/1962 Guthormsen ..... D21/681
4,603,855 A * 8/1986 Sebelle ..... 482/103
4,944,511 A 7/1990 Francis
D317,959 S 7/1991 Francis
5,209,461 A * 5/1993 Whightsil, Sr. ..... 267/155
5,226,867 A * 7/1993 Beal ..... 482/127
6,030,321 A * 2/2000 Fuentes ..... 482/83
6,126,580 A 10/2000 Francis et al.
6,440,044 B1 * 8/2002 Francis et al. ..... 482/114
6,447,430 B1 * 9/2002 Webb et al. ..... 482/98
6,458,061 B2 * 10/2002 Simonson ..... 482/103
6,685,602 B2 * 2/2004 Colosky et al. ..... 482/127

* cited by examiner

*Primary Examiner*—Stephen R. Crow
*Assistant Examiner*—Allana Lewin
(74) *Attorney, Agent, or Firm*—Blackwell Sanders Peper Martin LLP

(57) ABSTRACT

A resistance exercise machine has a frame that includes a base on the floor and upright posts on the base. Resistance packs mounted for adjustment up and down on the posts are equipped with cams that compensate for the increased resistance resulting from increasing deformation of the resistance elements in the packs. The resistance packs are interconnected by teeth on their rims which allow the packs to be arranged in a stack. An adjustable bench and seat are provided. One alternative is a direct drive system having angularly adjustable levers. Another alternative has a fixed number of resistance packs that can be selectively activated to add resistance.

9 Claims, 7 Drawing Sheets

FIG. 10.
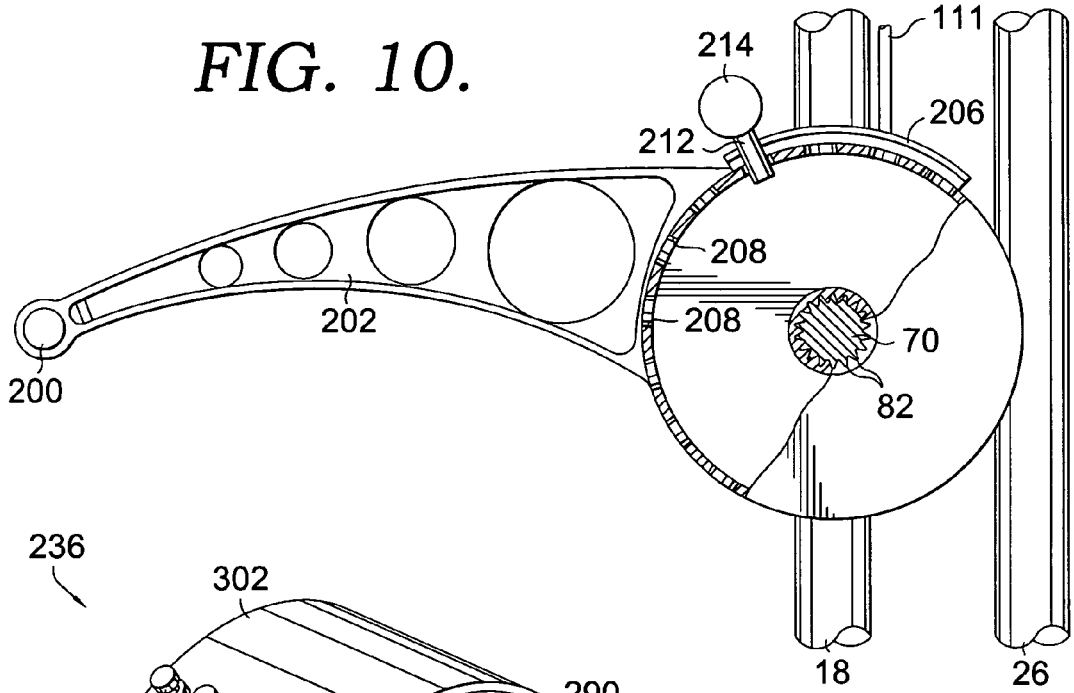
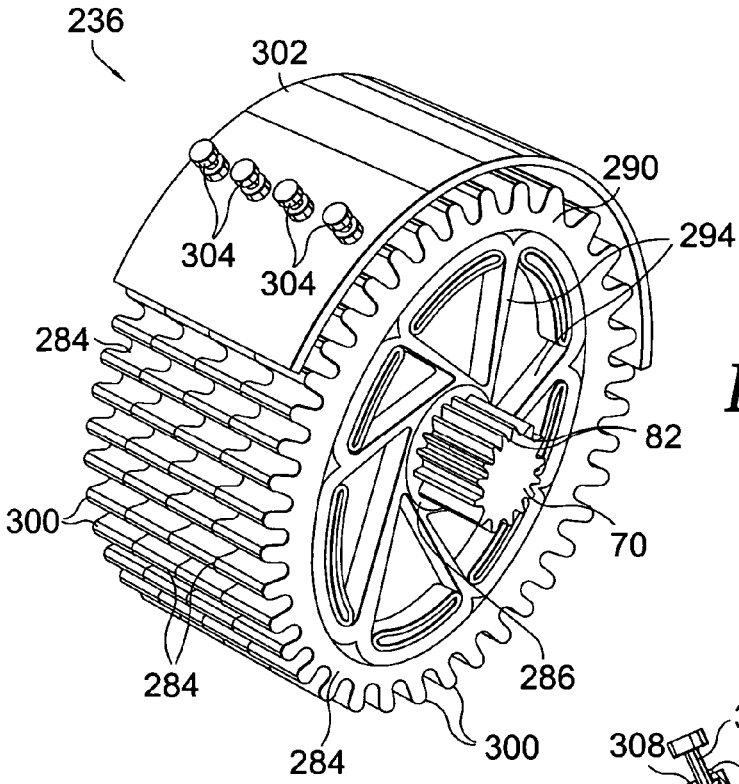
FIG. 11.
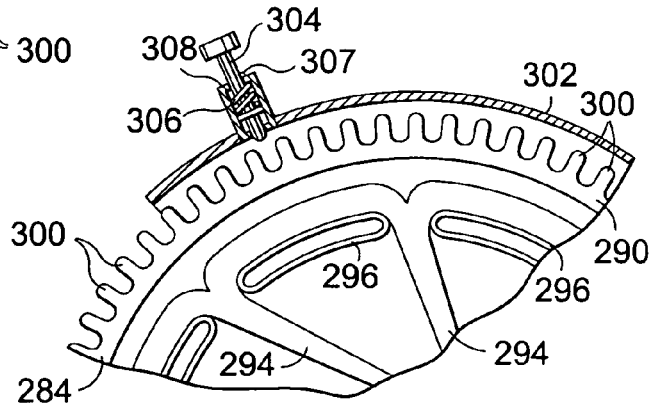
FIG. 12.

RESISTANCE EXERCISE MACHINE WITH STACKED RESISTANCE PACKS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates generally to resistance exercise equipment and more particularly to an exercise machine having resistance packs that are arranged in stacks for applying a resistance force.

BACKGROUND OF THE INVENTION

U.S. Pat. No. 4,944,511 to Francis is directed to a resistance exercise machine in which the resistive force is provided by stacked reels containing springs that are arranged to resist turning of the reels. This type of resistance system can function adequately in many applications. However, the springs can lose their effectiveness after extended use. Furthermore, springs provide increasing resistance as they are progressively deformed. Consequently, the last parts of an exercise movement are characterized by more resistance than the first parts. This inconsistent force over the full range of movement can be a significant disadvantage.

U.S. Pat. Nos. 6,126,580 and 6,440,044 to Francis et al. address the problem of inconsistent resistance in two different ways. First, resistance packs having deformable spokes are connected in a series arrangement that allows the actuator cord to be displaced a lengthy distance without a great variation in the resistance force. Second, a spiral pulley is provided to increase the moment arm with increasing displacement of the actuator cord in order to counteract the increasing resistance force.

Although this type of approach is generally satisfactory, it is disadvantageous because compensation can be made for the inconsistent force only within a relatively limited resistance range. Also, a somewhat complicated preload mechanism is required in order to adjust the resistance force. The spiral pulley that is used also adds to the cost and complexity of the resistance mechanism and to the amount of space that it requires.

SUMMARY OF THE INVENTION

The present invention is directed to a resistance exercise machine that exhibits a number of improved features compared to the machines that have been available in the past.

The machine of the present invention is characterized in one aspect by a stack of resistance packs that are connected in parallel combined with a relatively simple cam mechanism that counteracts the increased force that results from increased deflection of the resistance elements. This arrangement allows the actuator element to be displaced a lengthy distance with little variation in the resistance force, regardless of the number of resistance packs engaged. This type of cam system also has the advantages of being structurally simple, economical, compact and reliable.

Another feature of the invention is the construction of the resistance packs in a manner to provide unique interlocking teeth on their rims. This allows a parallel connection of the resistance packs at the rims so that each pack contributes equally to the resistance force, and packs can be conveniently added or subtracted to vary the resistance force that must be overcome. Also, the teeth allow minimum rotational adjustment when stacking.

Alternatively, the resistance packs can be provided in the form of a stack having a fixed number of units that may be selectively pinned or otherwise secured in an active condition where they contribute to the resistance force. In this manner, the resistance force that must be overcome can be varied by varying the number of the resistance packs that are active.

The invention is characterized in an additional aspect by a unique bench that can be adjusted angularly to accommodate different exercise movements. Another important feature of the invention is the construction of the machine in a manner allowing the resistance mechanisms to be adjusted up and down on the frame so that they can be positioned at an appropriate height for different exercise routines. Further, the bench is equipped with an adjustable seat that can be positioned as necessary to accommodate different users of the machine.

In an alternative embodiment of the invention, a direct drive resistance system provides a direct connection of the bars or other actuator elements with the resistance packs. This construction is simpler and more economical and is desirable in some applications. Levers may be provided to connect the bars of the machine with the resistance packs, and the levers may be annularly adjustable to accommodate different exercises and different users of the equipment.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views:

FIG. 10 is a fragmentary sectional view on an enlarged scale taken generally along line 10—10 of FIG. 8 in the direction of the arrows;

FIG. 11 is a perspective view of a resistance pack having an alternative construction according to another embodiment of the invention; and FIG. 12 is a fragmentary side elevational view of the mechanism shown in FIG. 11, with portions shown in section and a pin withdrawn from engagement with the teeth on the periphery of one of the resistance packs in the mechanism.

DETAILED DESCRIPTION OF THE INVENTION

Figure 1:
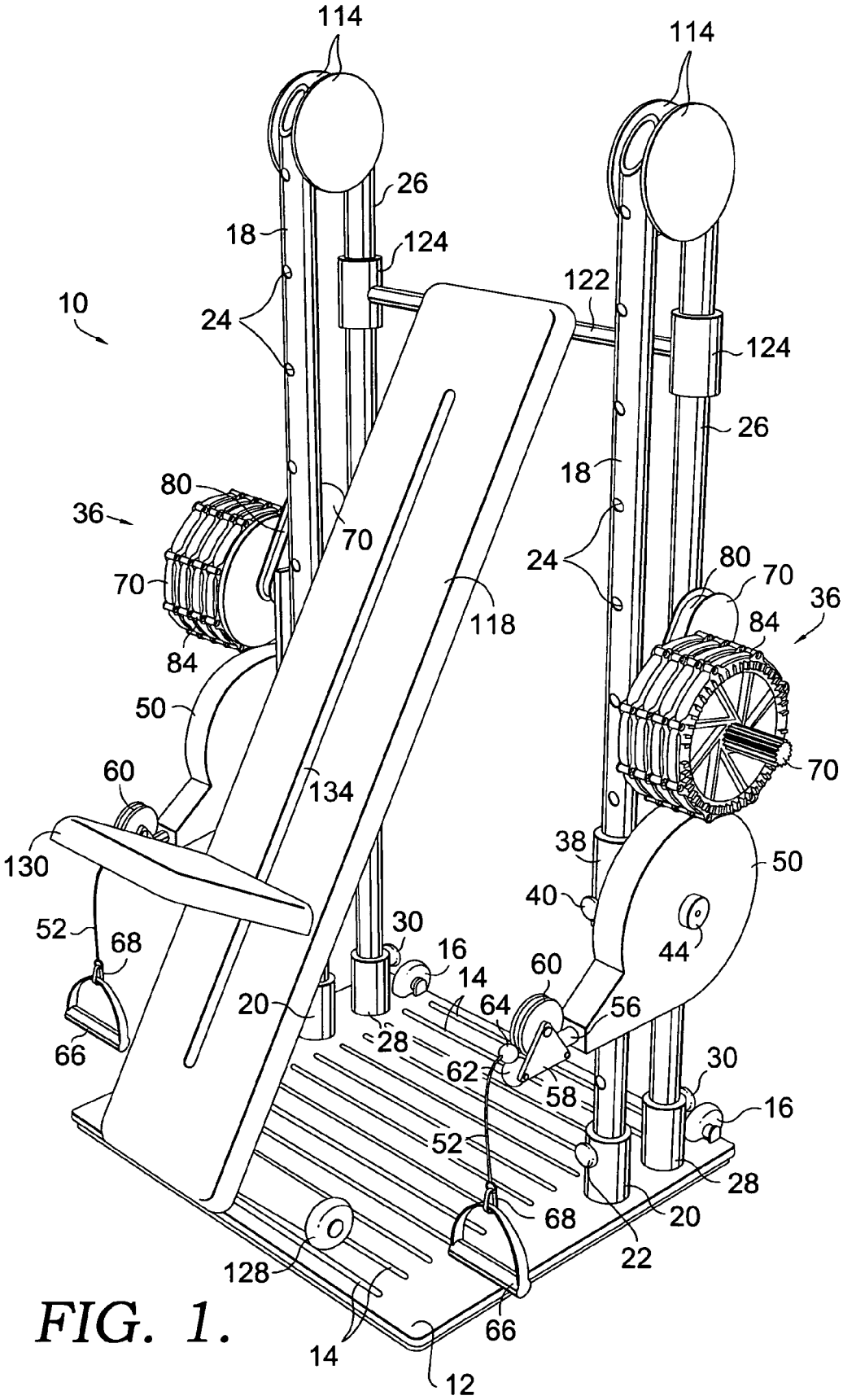
FIG. 1 is a perspective view of a resistance exercise machine constructed according to a preferred embodiment of the present invention.

Referring now to the drawings in more detail and initially to FIG. 1 in particular, numeral 10 generally designates a resistance exercise machine constructed in accordance with a preferred embodiment of the present invention. The machine 10 has a frame that includes a base that may take the form of a flat platform 12 that rests on a floor or other supporting surface. The upper surface of the platform 12 may have upwardly projecting ribs 14 that are spaced apart and parallel to one another. A pair of small wheels 16 may be provided on the back edge of the platform 12. The wheels allow the platform to be tipped and rolled along the floor or other surface that supports the machine in order to facilitation movement of the machine.

The frame of the machine is also provided with an upright structure which extends upwardly from the platform 12 and which includes a pair of vertical front columns or posts 18. The posts 18 are received at their lower ends in sleeves 20 that are secured to the upper surface of the platform 12. Releasable screws or other fasteners 22 are extended through the sleeves 20 and releasably lock the posts 18 in place. The fasteners 22 can be removed in order to allow the posts 18 to be disconnected from the platform 12 for disassembly of the machine. Each post 18 is provided with a plurality of spaced apart openings 24 on its forwardly facing surface. The posts 18 are located adjacent to the opposite side edges of the platform 12 on the rear half of the platform.

The upright structure of the frame of the machine also includes a pair of rear posts 26 that are located behind the respective front posts 18. Each of the rear posts 26 is received at its lower end in a sleeve 28 secured to the upper surface of the platform 12. Screws or other releasable fasteners 30 (FIG. 3) may be extended through the sleeves 28 and received in openings in the lower end portions of the posts 26 in order to releasably lock the posts 26 to the platform 12. The fasteners 30 may be withdrawn to allow the posts 26 to be detached from the platform 12. Each of the posts 26 is provided with a plurality of spaced apart openings 34 (see FIG. 3) in its rearwardly facing surface.

Figure 2:
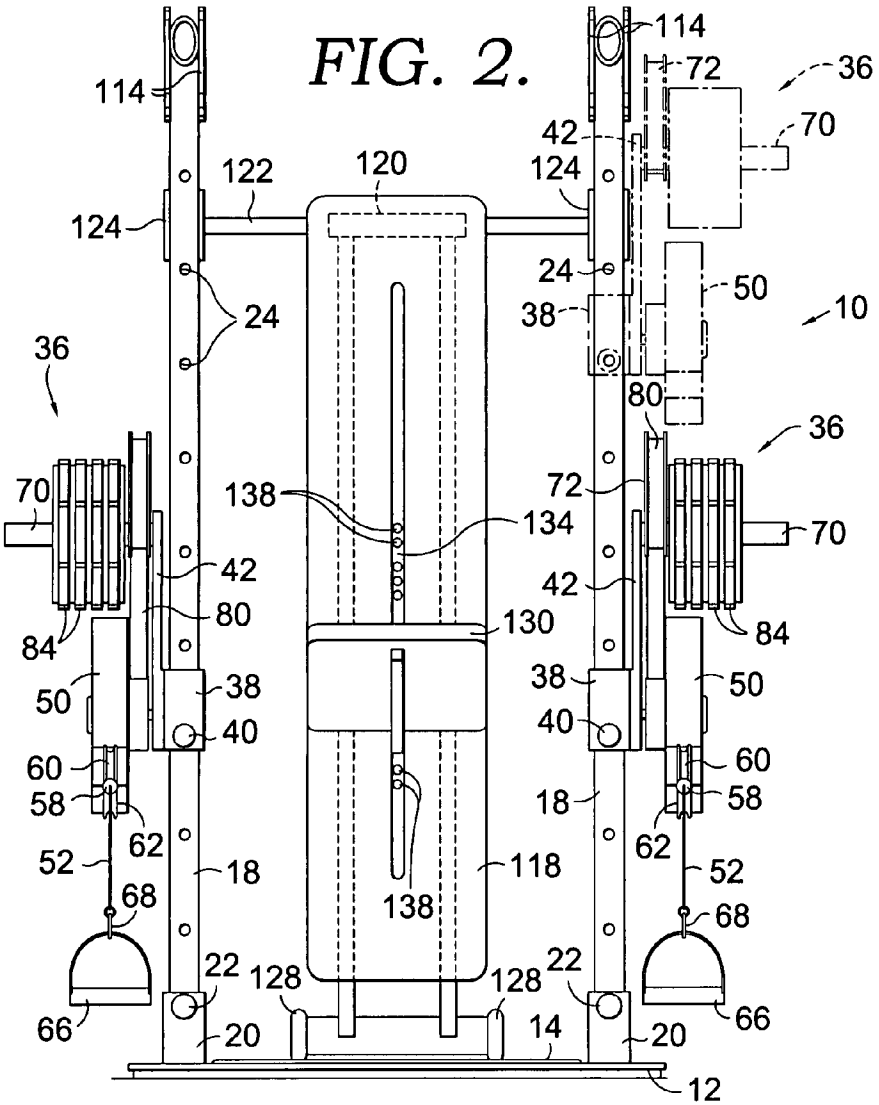
FIG. 2 is a front elevational view of the machine shown in FIG. 1, with the broken lines illustrating adjustment of one of the resistance mechanisms upwardly on the columns of the frame of the machine.

The machine 10 is provided with a pair of resistance mechanisms which are generally identified by numeral 36. The resistance mechanisms 36 are mounted for up and down movement on the respective front posts 18. As best shown in FIG. 2, sleeves 38 are fitted around the posts 18 and may be secured in place by spring loaded pins 40 which may be extended through the sleeves 38 and into selected openings 24 on the posts 18.

A vertical plate 42 is secured to the outside surface of each sleeve 38 and is located immediately outwardly from posts 18. A horizontal shaft 44 (see FIG. 6 in particular) is mounted to extend outwardly from each of the plates 42. With continued reference to FIG. 6 in particular, a relatively large pulley 46 and a smaller sheave 48 are mounted on the shaft 44 and connected with one another. The pulley 46 and sheave 48 are mounted within a housing 50.

Figure 6:
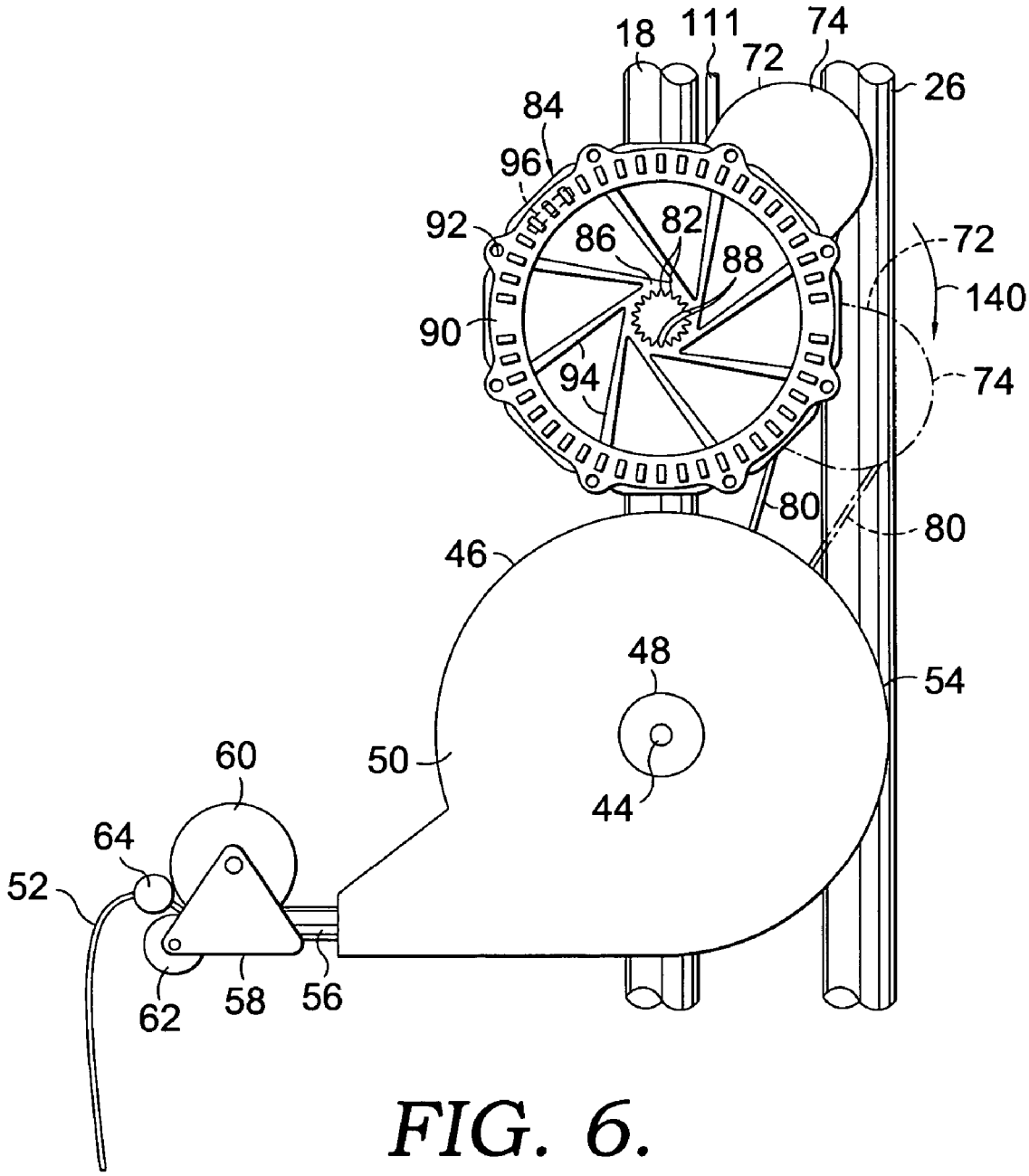
FIG. 6 is a fragmentary side elevational view of one of the resistance mechanisms on an enlarged scale, with the broken lines showing the cam of the mechanism pivoted from its initial position during an exercise movement.

A flexible actuator cable 52 is wrapped around each large pulley 46 and secured to the pulley 46 at one end, as indicated at 54 in FIG. 6. A horizontal tube 56 secured to the housing 50 carries a swivel 58 which is mounted to turn about the axis of the tube 56. Cable 52 extends from pulley 46 through the tube 56. The swivel 58 carries a pair of idler pulleys 60 and 62 between which the cable 52 is extended. A ball 64 is secured to the cable 52 in order to limit the extent to which the cable can be retracted.

Figure 3:
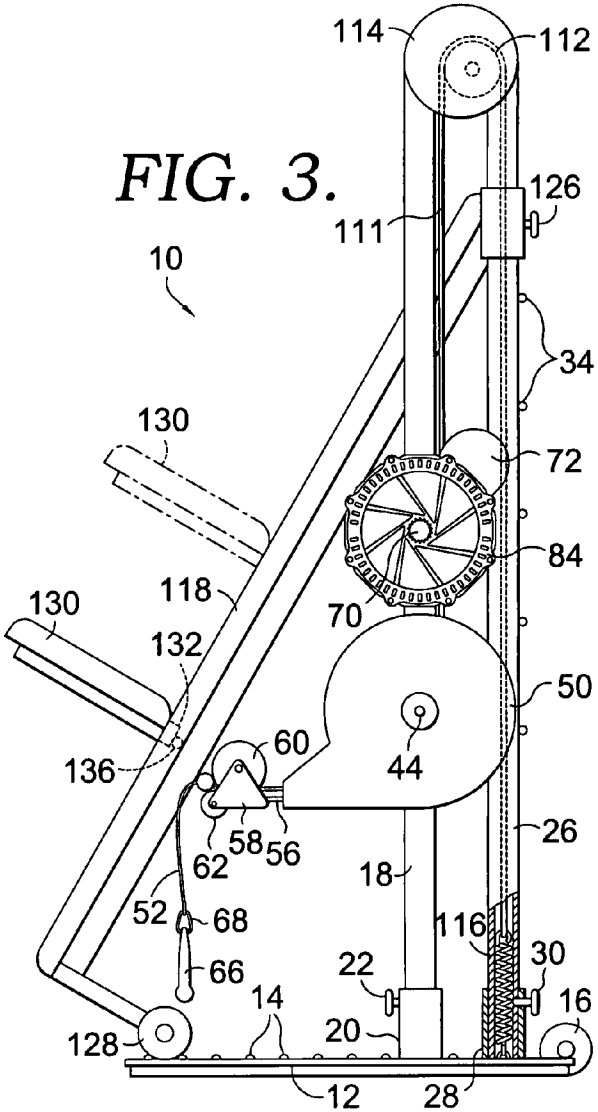
FIG. 3 is a side elevational view of the machine shown in FIG. 1, with the broken lines illustrating adjustment of the seat upwardly on the bench of the machine.

As shown in FIGS. 1–3, the free end of each cable 52 may be equipped with a hand grip 66 which may be grasped with the hand of a user of the machine 10. The hand grips 66 may be detachably connected to the cables 52 by rings 68 or any other suitable manner.

Figure 4:
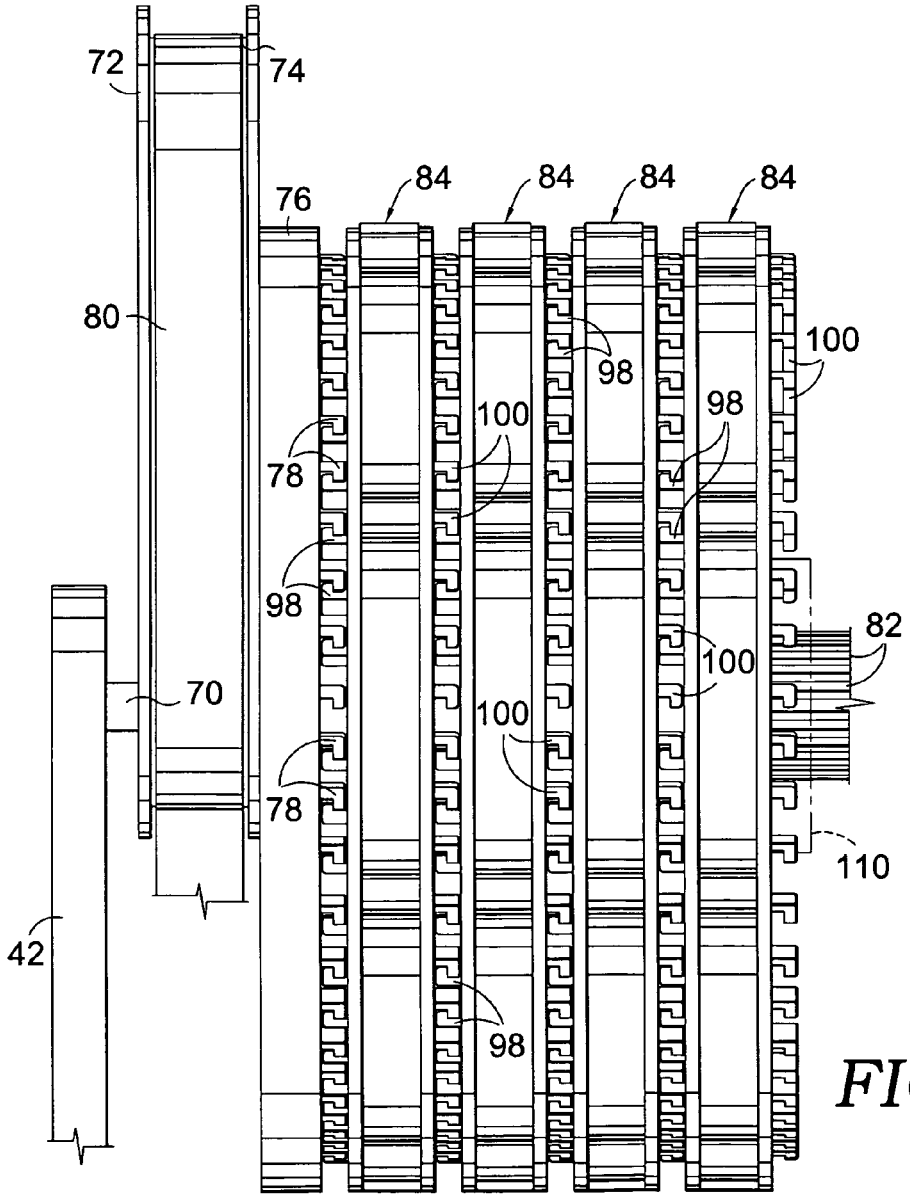
FIG. 4 is a fragmentary front elevational view on an enlarged scale showing one of the resistance mechanisms of the machine.

As shown particularly in FIG. 4, a horizontal axle or shaft 70 is secured to the upper portion of each plate 42 and extends outwardly above and parallel to shaft 44. A cam 72 is mounted on shaft 70 in a manner to rotate on the shaft about one end of the cam (its lower end). The cam 72 has an outer end portion 74 that is spaced outwardly from shaft 70. A disk 76 is secured to one flange of the cam 72 and is mounted to rotate on the shaft 70. The outwardly facing surface of disk 76 is provided with a plurality of spaced apart teeth 78 located on the rim area of the disk. Disk 76 may be provided with a means (such as a resistance pack 84) to provide cable 52 retraction when no resistance racks are stacked.

A transmission element between the small sheave 48 and cam 72 is provided by a flexible belt 80 which may be passed around the sheave 48 and secured to the sheave at one end. The belt 80 is also passed around the outer end portion 74 of cam 72 and connected at one end with the cam 72.

Each shaft 70 is enlarged on its outer end portion and provided with a plurality of splines 82. A plurality of resistance packs each generally identified by numeral 84 may be mounted on the shaft 70 in a manner to mate with the splines 82. As best shown in FIG. 6, each of the resistance packs 84 has a hub 86 that is splined at 88 in order to mate with the splines 82 on shaft 70. Each resistance pack 84 has a generally circular rim 90 which may have opposite sides that are spaced apart and connected by suitable connections 92. A plurality of resistance elements on each resistance pack 84 may take the form of elastomeric spokes 94 that extend outwardly from the hub 88 to the rim 90. The spokes in adjacent pairs may be drawn around bosses 96 (FIG. 6) that extend between the opposite sides of the rim 90. When the rim 90 of each resistance pack is turned relative to the hub, the spokes 94 are stretched and apply a resistance to the stretching or deformation which serves as the resistance force of the exercise machine 10.

Figure 5:
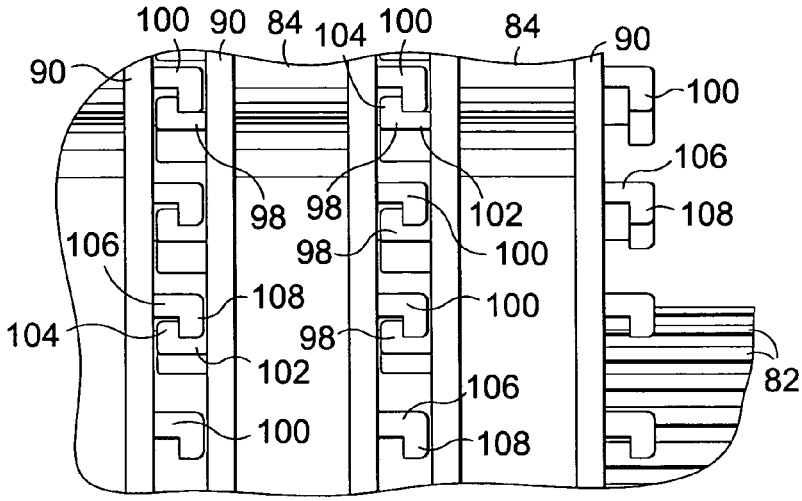
FIG. 5 is a fragmentary elevational view on an enlarged scale showing the teeth of the resistance packs interlocked in accordance with a preferred embodiment of the invention.

The resistance packs 84 may be arranged in a stack on the splines 82 of shaft 70, with a selected number of the resistance packs 84 applied in order to achieve the desired resistance force. As best shown in FIGS. 4 and 5, the rim 90 of each resistance pack is provided with a plurality of teeth 98 that extend from one side of the rim 90 and a second plurality of teeth 100 that project from the opposite side of the rim 90. The teeth 98 and 100 occupy substantially the entire circumferential area of the resistance pack.

With particular reference to FIG. 5, each tooth 98 and 100 is an L-shaped member. Each tooth 98 has a shank portion 102 which extends outwardly from rim 90 in a direction parallel to the axis of shaft 70. An arm 104 extends from the outer end of each shank 102 in a direction perpendicular to the shank 102 and generally tangent to the periphery of the resistance pack 84. Each tooth 100 has a shank 106 that extends outwardly from the side of the rim 90 opposite shank 102. Shank 106 extends in a direction opposite shank 102. An arm 108 extends from the outer end of each shank 106 and is perpendicular to the shank and generally tangent to the periphery of the resistance pack 84. The arms 104 and 108 extend in opposite directions. Consequently, the arms 104 and 108 are able to interlock in the manner shown in FIG. 5 when two of the resistance packs 84 are placed adjacent to one another on the splines 82 with their adjacent teeth interlocked. The interlocking of the teeth 98 and 100 in this manner results in the resistance packs 84 all rotating together in unison. Also, a large number of small teeth allow minimum rotational adjustment when stacking.

As FIG. 4 illustrates, virtually any desired number of the resistance packs 84 can be arranged in a stack on the splines 82 with the teeth 98 and 100 interlocked, and with the teeth 98 of the initial resistance pack 84 interlocked with the teeth 78 of disk 76. (Teeth 78 have substantially the same configuration as teeth 100). Thus, the rotation of disk 76 is transmitted into rotation of the rims 90 of all of the resistance packs that are stacked on the splines 82. A releasable collar 110 (FIG. 4) may be applied to the splines 82 and positioned against the outermost resistance pack 84 in order to more fully secure the resistance packs on the splines 82 with the teeth of the resistance packs interlocking.

The resistance packs 84 can be constructed to offer different resistances, much in the nature of conventional weight plates. For example, the resistance packs can be provided in various thicknesses to simulate different "weights". Thus, to achieve a resistance equivalent to 60 pounds, one resistance pack having a resistance equivalent to 50 pounds can be applied to the splines 82 of the shaft 70, and a second resistance pack of lesser thickness and a resistance equivalent to 10 pounds can also be applied to the splines and interconnected with the first (50 pound) resistance pack. In this manner, virtually any desired resistance force can be achieved without the need for an undue number of resistance packs.

As previously indicated, the resistance mechanisms 36 are adjustable up and down on the posts 18. Vertical adjustment of the resistance mechanisms is facilitated by a counterbalance system that includes a flexible cable 111 (see FIG. 3 in particular) which may be secured at one end to the plate 42. Each cable 111 is drawn around a pulley 112 (FIG. 3) which is mounted between a pair of plates 114 secured to the upper end portions of the posts 18 and 26. The cables 111 extend downwardly within rear posts 26 and are connected at their lower ends with tension springs 116 located in the bottom portions of posts 26. The tension springs 116 urge the cables 111 in a direction tending to raise the resistance mechanisms 36, thus providing a counterbalance force to the weight of the resistance mechanisms when pins 40 are released.

The machine 10 is provided with a bench 118 having an upper end provided with a horizontal sleeve 120 (FIG. 2) on the back surface of the bench. A rod 122 extends through the sleeve 120 in a manner allowing the bench 118 to turn about the axis of the rod 122. The rod 122 connects at its opposite ends with a pair of collars 124 which are mounted on the rear posts 26. The collars 124 may be releasably secured at a selected height by means of spring loaded pins 126 (see FIG. 3) which extend through the collars 124 and may be extended into selected openings 34 to fix the height of the top end of a bench 118.

The lower end of bench 118 is provided with a pair of rollers 128 which are applied to the upper surface of the platform 12. The size of the rollers 128 is such that the rollers fit closely between adjacent ridges 14 to provide a stable base for the lower end of the bench 118. The rollers 128 can move completely off of the platform 12 if desired.

The bench 118 is equipped with an adjustable seat 130. A spring loaded pin 132 (FIG. 3) on the underside of the seat 130 fits in a groove 134 that extends generally along the center of the bench 118. The pin 132 is urged by a spring 136 to enter openings 138 (FIG. 2) which are spaced along the length of the groove 134. The pins 132 can be withdrawn from the openings 138 so that the seat can be moved along the length of the groove 134, as indicated by the broken lines in FIG. 3. When the seat has been adjusted to the desired position, the pin 132 can be released to enter the opening 138 with which it is then aligned in order to lock the seat releasably in place.

In use, the bench 118 can be adjusted to the desired angular orientation and can be moved between a substantially vertical position to virtually any desired angle, including a completely horizontal position. The seat 130 can likewise be adjusted on the bench to the desired position for the particular exercise movement that is to be undertaken (or the seat can be removed). The resistance mechanisms 36 can be adjusted up or down such that they are located in the proper position for the exercise that is to be undertaken. The machine 10 allows for a wide variety of exercises. For upper body exercises, the hand grips 66 can be gripped with the hands and used to extend the cables 52, either individually or at the same time. Suitable straps (not shown) can be attached to the rings 68 in place of the hand grips 66 to accommodate leg exercises, with the straps drawn around the ankles of the user in this case. A bar (also not shown) can be connected between the two rings 68 if desired.

When the cables 52 are extended during an exercise, they rotate the large pulley 46 and the sheave 48 which is connected to pulley 46. As the sheave 48 is rotated, belt 80 is progressively wound around the sheave 48 and thus causes the cam 72 to pivot on shaft 70 from the solid line position of FIG. 6 to the broken line position of FIG. 6. Due to the connection of cam 72 with the toothed plate 76, plate 76 turns with the cam 72 on shaft 70. The mating of the teeth 78 of plate 76 with the teeth 98 of the first resistance pack 84 causes the rim 90 of the first resistance pack to turn. Because of the interlocking teeth 98 and 100 of each resistance pack 84 in the stack, the rims 90 of all of the resistance packs are thus rotated about the axis of shaft 70. Because the hubs 86 of the resistance packs are fixed to the splines 82 and the shaft 70 is fixed against rotation, rotation of the rims 90 results in deformation of the spokes 94. The spokes 94 resist this deformation and thus resist extension of the cables 52 to provide a resistance force.

The resistance force exerted by the spokes 94 tends to increase with increased deformation of the spokes, and this increased force is in large part counteracted by the cam 72. The cam provides a lever arm which has a length equal to the length of a line drawn perpendicular to the belt 80 and intersecting with the center of the shaft 70. In the solid line position of cam 72 in FIG. 6, the lever arm is relatively short. Conversely, as the cam 72 pivots in a clockwise direction as indicated by the arrow 140 in FIG. 6, the length of the lever arm increases progressively. By reason of the progressively increasing length of the lever arm, a progressively increased mechanical advantage is obtained as the cam 72 pivots from the solid line position of FIG. 6 to the broken line position. This increasing leverage that is provided by the cam 72 substantially offsets the increasing resistance due to the progressive deformation of the spokes 94 as the cable 52 is progressively extended. At the end of the exercise movement, the cable 52 is released such that the spokes 94 are able to straighten out and rotate the cam 72 and the other components to their initial positions.

In this fashion, the cam 72 acts as a variable length lever arm that increases in its effective length as the exercise movement progresses, thus providing an increasing mechanical advantage that counteracts the increasing force of the resistance packs 84. It is noted that the cam 72 is simply an arm that is arranged to vary its effective length as a lever arm as it pivots during an exercise movement. The cam 72 thus acts effectively without the complexity associated with spiral pulleys and other more complicated structures.

The provision of the wheels 16 allows the entire machine to be tilted rearwardly on the wheels 16 and rolled to a storage position or any other desired position. The posts 18 and 26 can be removed from the sleeves 20 and 30 for disassembly of the frame and to facilitate packaging and storage. The resistance mechanisms 36 can also be completely removed from the posts 18, and the bench 118 can likewise be detached from the rear posts 26.

Figure 7:
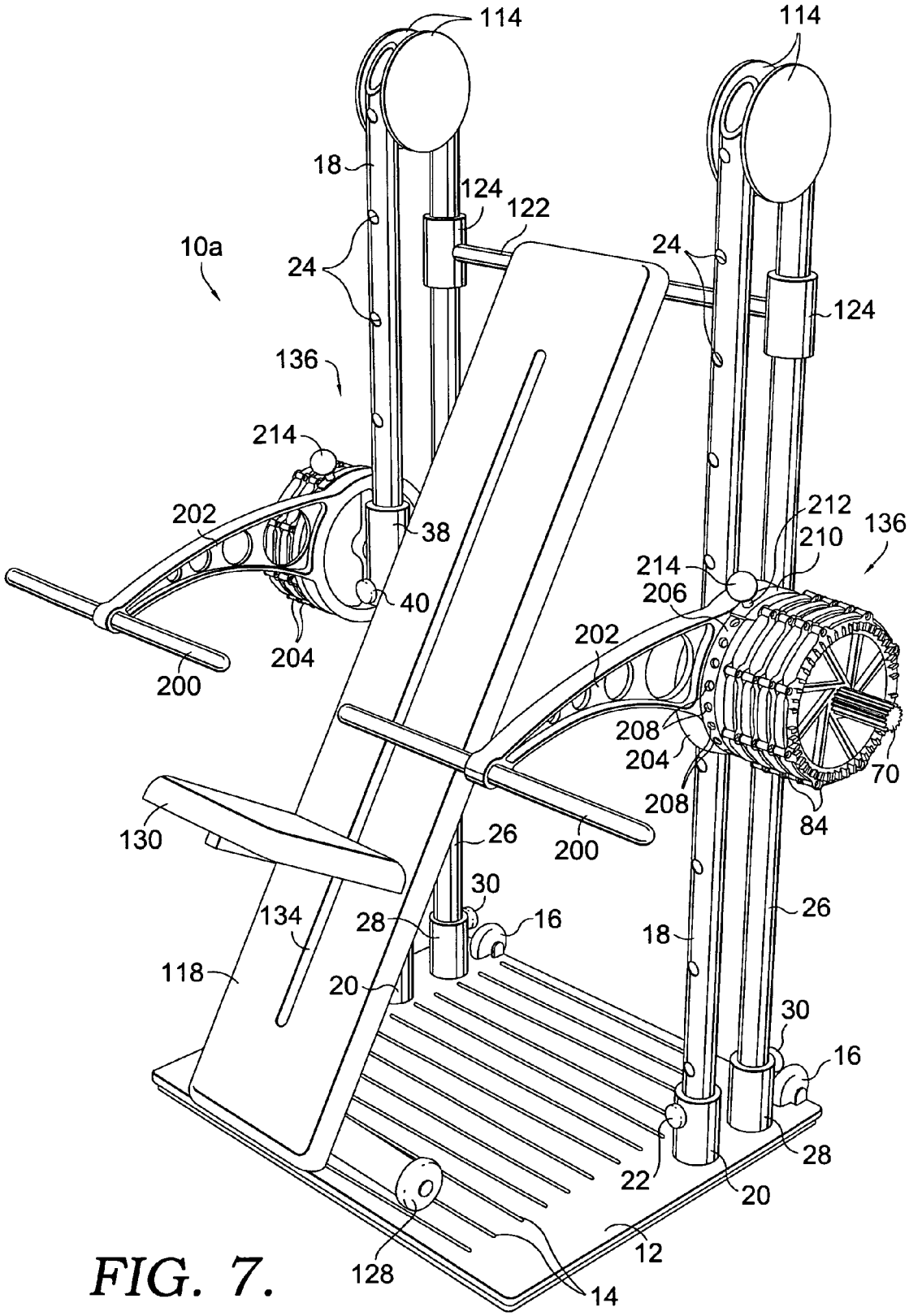
FIG. 7 is a perspective view of an exercise machine constructed according to an alternative embodiment of the present invention.
Figure 9:
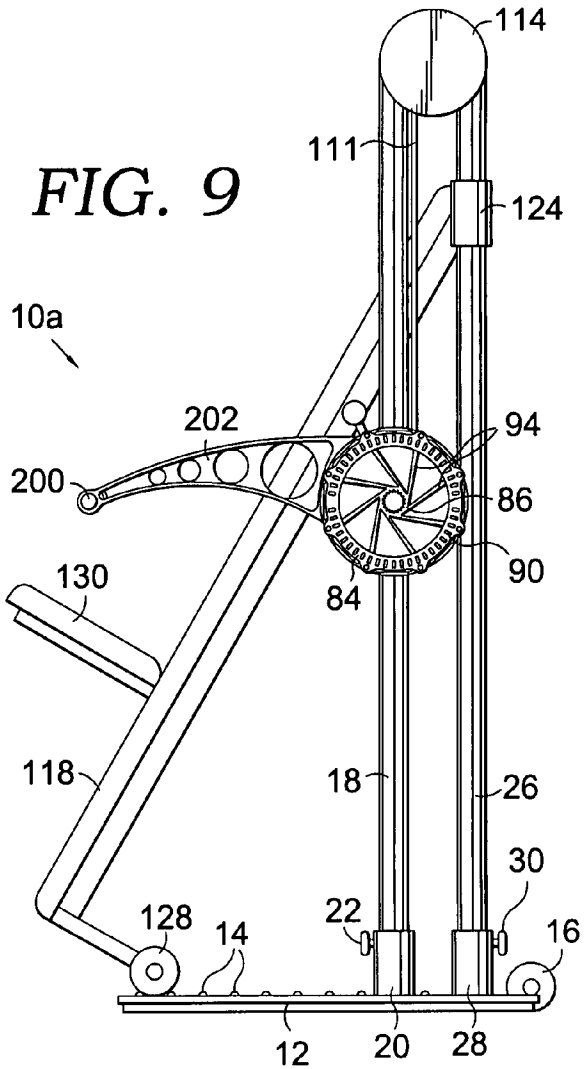
FIG. 9 is a side elevational view of the exercise machine shown in FIG. 7.
Figure 8:
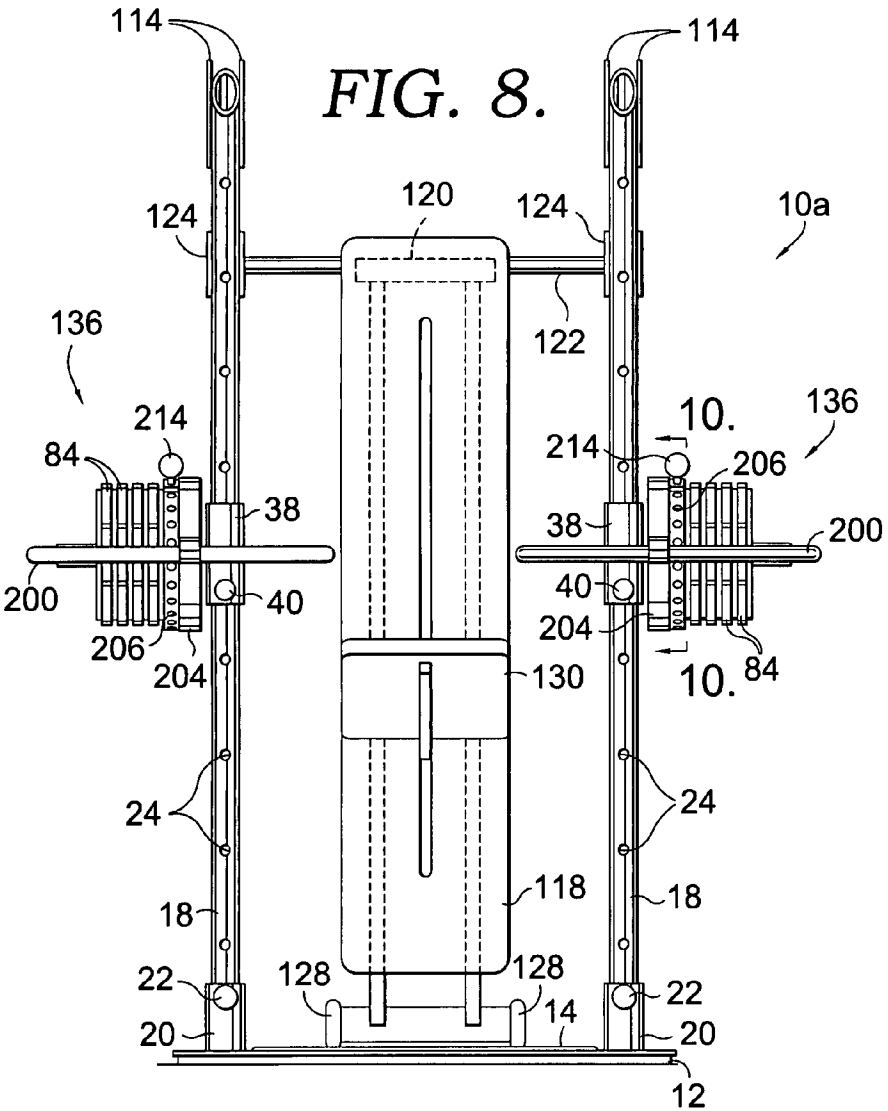
FIG. 8 is a front elevational view of the exercise machine shown in FIG. 7.

FIG. 7 depicts an alternative embodiment of the invention which is generally identified by movement 10*a* and which has many components similar to the embodiment of FIGS. 1–6, and those common components are identified by the same reference numerals in FIGS. 7–9. The principal difference in the embodiment shown in FIG. 7 is that the resistant mechanism, generally identified by numeral 136, is a direct drive resistance mechanism. In this respect, there is no cam 72 provided in the resistance mechanism 136, nor is any other compensation made for the increased resistance that is provided with increased deformation of the spokes 94.

In the machine 10*a* shown in FIGS. 7–10, a pair of bars 200 are provided on opposite sides of the bench 118 and are connected with the resistance mechanisms 136 by curved levers 202. Each lever 202 connects on the end opposite bar 200 with a rigid disk 204. The disks 204 are mounted for rotation on the shafts 70. A wheel 206 is mounted to turn on each of the shafts 70 at a location adjacent to and outwardly of the disk 204. Each of the wheels 206 has teeth (not shown) which mate with the teeth 98 of the adjacent resistance pack 84 in substantially the same manner as described in connection with disk 76. Each wheel 206 has a plurality of spaced apart openings 208 in its periphery.

Each of the disks 204 connects with an arcuate plate 210 which overlies the periphery of the adjacent wheel 206. Each of the arcuate plates 210 is equipped with a spring loaded pin 212 having a ball shaped handle 214 on its outer end. The pin may be fitted through plate 210 and extended into selected openings 208 in order to allow adjustment of the angular orientations of the lever 202.

The machine 10*a* of FIGS. 7–10 is used in a manner similar to the machine 10, with the bars 200 providing actuator elements that are gripped by a user stationed on the platform 12. When the bars 200 are raised or lowered, the levers 200 cause rotation of the disks 204 and the wheels 206 that are connected with disk 204 through the connection provided by the pins 212. The resistance packs 84 provide resistance in the same manner described in connection with the machine 10.

The levers 202 can be varied in their angles to accommodate different types of exercise movements. For example, with the levers 202 extending generally horizontally as shown in FIG. 7, exercises such as presses and curls can be conveniently carried out with the bars 200 in positions to be raised.

Alternatively, the levers 202 can be adjusted to various upward angles (before resistance packs are stacked) for exercises such as pull down exercises to be performed. To adjust the angles of the levers 202, the pins 212 can be withdrawn from openings 208, and the levers swung upwardly to the desired angular orientation before the pins 212 are again extended into the openings 208 which are then aligned with them.

FIGS. 11 and 12 depict an alternative resistance mechanism 236 which may replace the resistance mechanisms previously described. The resistance mechanism 236 may include a plurality of resistance packs 284 which have hubs 286 and spokes 294 identical to the hubs 86 and spokes 94. The outer ends of adjacent spokes 294 are drawn around bosses 296 (FIG. 12) on the rims of the resistance packs 284. The hubs 286 may be fitted on the splines 82 of the horizontal shaft 70.

Rather than being provided with interlocking teeth such as the teeth 98 and 100 described previously, the resistance packs 284 are not interlocked at their rims but are instead provided with teeth 300 which are spaced apart and extend radially outwardly on the rims 290 of the resistance packs 284. An arcuate plate 302 may be connected with the frame of the resistance mechanism and provided with a plurality of pins 304, one pin for each resistance pack 284. The pins 304 extend through the plate 302 and are aligned with the peripheries of the respective resistance packs 284.

As shown in FIG. 12, each of the pins 304 is urged inwardly by a compression spring 306 which normally causes the pin 304 to enter a space between adjacent teeth 300 of the corresponding resistance pack 284. However, the pins 304 can be secured in a retracted position by pulling them outwardly to withdraw a button 307 on the shank of each pin through a slot 308. The pin 304 may then be rotated to move the button 307 out of alignment with slot 308, thus retaining the pin 304 in the retracted position of FIG. 12 wherein the pin is not engaged between the teeth 300.

In the embodiment of FIGS. 11 and 12, the splined shaft 70 is rotated by the actuator element of the exercise machine (the cables 52 and related components shown in the exercise machine 10 or the bars 200, levers 202 and related components in the machine 10*a*). The hubs 286 of the resistance packs 284 are turned with the rotation of the shaft 70. The resistance packs 284 that are not engaged by the pins 304 simply turn with shaft 70 and do not provide any resistance force. However, the resistance packs 284 which have the pins 304 engaged with their teeth 300 are locked against movement at their rims 290, and the spokes 294 of these resistance packs are deformed to provide a resistance force. Thus, in the embodiment shown in FIGS. 11 and 12, the resistance force can be varied by selecting which of the resistance packs 284 in the stack are engaged in an active position by means of the pins 304 being extended between the teeth 200 of the active resistance packs. In the embodiment of FIGS. 11 and 12, a fixed number of resistance packs 284 may be provided on the shaft 70, and the resistance force can be varied by selecting which of the resistance packs are placed in an active position.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. In a resistance exercise machine, a resistance mechanism comprising:

an axle on the machine;

a plurality of resistance packs arranged on said axle for rotation, said packs having resistance elements which resist rotation of said packs and which provide increasing resistance upon increasing rotation of said packs;

a cam on the machine supported for pivotal movement and coupled with said resistance packs to effect rotation of said packs upon pivotal movement of said cam, said cam having an outer end portion which is arranged to provide a lever arm having an increasingly greater length upon increasing pivotal movement of said cam;

a pulley on the machine supported for rotation about an axis offset from said axle;

a transmission element coupling said pulley with said cam to effect pivotal movement of said cam upon rotation of said pulley, said transmission element engaging said outer end portion of said cam; and an actuator element coupled with said pulley and accessible for manual displacement thereof in a manner to effect rotation of said pulley, with said resistance packs acting to resist said displacement and said cam being pivoted increasingly to at least partially compensate for the increasing resistance provided by said packs upon increasing rotation of said pulley.

2. A resistance mechanism as set forth in claim 1, wherein said cam is supported for pivotal movement about an axis coincident with said axle.

3. A resistance mechanism as set forth in claim 1, including:

a sheave coupled with said pulley to be rotated upon rotation of said pulley; and a belt drawn around said outer end portion of said cam and coupled with said sheave to provide said transmission element.

4. A resistance mechanism as set forth in claim 1, wherein said actuator element comprises a flexible cable drawn around said pulley and carrying an attachment for engagement by a user of the machine.

5. A resistance mechanism as set forth in claim 1, including mating teeth on said packs for releasably connecting adjacent packs together in a stack.

6. A resistance mechanism as set forth in claim 1, wherein said axle is substantially horizontal.

7. A resistance mechanism comprising:

a shaft;

a plurality of resistance packs arranged on said shaft for rotation, each of said resistance packs having a hub fitting on said shaft and a rim presenting opposite first and second sides;

a plurality of deformable resistance elements extending between said hub and rim and acting to resist rotation of said rim relative to said hub;

a plurality of first teeth projecting from said first side of said rim of each resistance pack at spaced apart locations; and a plurality of second teeth projecting from said second side of said rim of each resistance pack at spaced apart locations, said first teeth of each resistance pack having selected portions arranged to underlie selected portions of said second teeth of an adjacent resistance pack to effect releaseable interlock between said first teeth and said second teeth of an adjacent resistance pack to allow a selected number of resistance packs to be arranged on said shaft and interlocked at said rims.

8. A resistance mechanism as set forth in claim 7, wherein:

each of said first teeth includes a shank projecting from said first side of said rim and an arm extending from said shank; and each of said second teeth includes a shank projecting from said second side of said rim and an arm extending from said shank of each of said second teeth, said arms of the second teeth extending in directions substantially opposite to said arms of the first teeth to allow said arms of the first teeth of each resistance pack to releasably interlock with said arms of the second teeth of an adjacent resistance pack.

9. A resistance mechanism as set forth in claim 8, wherein:

each of said rims is generally circular; and said arms of the first and second teeth extend generally tangential to said rim.

* * * * *